US005100119A

United States Patent [19]

Komada et al.

[11] Patent Number: 5,100,119

[45] Date of Patent: Mar. 31, 1992

[54] PAPER HANDLING APPARATUS

[75] Inventors: Takashi Komada; Nobuyoshi Seki; Yoshihide Sugiyama; Kenji Mori; Masashi Shimada; Tsutomu Ichinose; Yuji Ueno; Nobuyuki Morii, all of Nagoya; Goro Mori, Tokyo; Masahiro Minato, Tokyo; Shin Umeda, Tokyo, all of Japan

[73] Assignee: Ricoh Company, Ltd., Tokyo, Japan

[21] Appl. No.: 462,763

[22] Filed: Jan. 10, 1990

[30] Foreign Application Priority Data

| | | | |
|---|---|---|---|
| Jan. 18, 1989 | [JP] | Japan | 1-7608 |
| Jan. 18, 1989 | [JP] | Japan | 1-7610 |
| Jan. 19, 1989 | [JP] | Japan | 1-8529 |
| Dec. 4, 1989 | [JP] | Japan | 1-313507 |

[51] Int. Cl.[5] ..... B42B 1/02

[52] U.S. Cl. ..... 270/53; 270/58

[58] Field of Search ..... 270/37, 53, 58; 227/110, 111, 126, 156

[56] References Cited

U.S. PATENT DOCUMENTS

| | | | |
|---|---|---|---|
| 4,508,329 | 4/1985 | Hubler | 270/53 |
| 4,681,310 | 7/1987 | Cooper | 270/53 |
| 4,762,312 | 8/1988 | Ushirogata | 270/53 |
| 4,901,994 | 2/1990 | Ishiguro | 270/53 |
| 4,928,941 | 5/1990 | Uto | 270/53 |

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A paper handing apparatus having a plurality of bins, a chuck unit and a stapler unit movable up and down along the bins, and a sorting unit. The sorting unit distributes a number of paper sheets received from a copier or similar image forming apparatus to the bins, while the stapler unit binds an end portion of each of the stacks of paper sheets loaded in the individual bins. The stapler is movable between and lockable at a position for binding a paper stack and a position for supplying staples. The stapler unit is removable from the sorting unit. Doors such as a stapler door are provided on the housing of the apparatus. When a door other than the stapler door is opened when the stapler is performing a stapling operation, the stapling operation is continued until it completes.

9 Claims, 16 Drawing Sheets

1 STAPLE OPERATION
STAPLE SEQUENCE COUNTER=1 ?
STAPLE SEQUENCE COUNTER=2 ?
STAPLE SEQUENCE COUNTER=3 ?
STAPLE SEQUENCE COUNTER=4 ?
A
B
C
D
Y
N
TURN OFF CHUCK SOLENOID
SET ONE STAPLE OPERATION END FLAG
INCREMENT STAPLED STACK COUNTER KEY BY 1
STAPLED STACK COUNTER =RESERVED STACK MEMORY ?
AUTOSTAPLING ?
A3, DLT SIZE ?

DOOR/COVER OPEN (STAPLER-ORIENTED)
STAPLING ?
N
Y
RETURN
STAPLER DOOR OPENED ?
Y
N
SORTER DOOR OPENED ?
Y
N
SORTOR TOP COVER OPENED ?
Y
N
RETURN
CHUCK UNIT MOVING FORWARD ?
Y
N
STAPLE SEQUENCE COUNTER = 1
RESET STAPLE SEQUENCE COUNTER TO 0
TURN OFF CHUCK MOTOR
RETURN

PAPER HANDLING APPARATUS

BACKGROUND OF THE INVENTION

The present invention relates to a paper handling apparatus of the type having a plurality of bins and a chuck unit and a stapler unit which are movable along the bins, and causing the stapler unit to bind an end portion of a stack of paper sheets which have been received from a copier or similar image forming apparatus, sorted, and then stacked on any one of the bins.

A copier, for example, is operable with an automatic document feeder (ADF) and a sorter which sorts a plurality of copy sheets associated with each of a plurality of documents in order of page and thereby produces a plurality of sets of copies. More specifically, while the ADF sequentially feeds the documents to a reading section of the copier in order of page, the sorter distributes the resulting copies of each document one by one to bins thereof. A paper handling apparatus capable of automatically stapling stacks of paper sheets each being distributed to respective one of bins in order of page is disclosed in Japanese Patent Laid-Open Publication (Kokai) No. 57-63561, for example. This kind of apparatus saves time and labor necessary for one to take out the stacks of copy sheets from the individual bins and staple them one by one. In the prior art apparatus, each paper stack is fully pulled out of the associated bin and transferred to an elevatable tray to be stapled there. Another paper stack to be stapled next is pulled out onto the stapled paper stack and stapled there. By such a sequence, a plurality of stapled sets of copies are piled up one upon another. While such a prior art paper handling apparatus allows the stapled copies to be readily taken out, it needs a bulky device for pulling out a paper stack onto the tray and a large exclusive space for the tray, resulting in an increase in cost and in space for installation.

In the light of the above, there has also been proposed a paper handling apparatus capable of automatically stapling paper stacks sorted into successive bins without increasing the overall size of the apparatus and the space for installation. This kind of apparatus has a plurality of bins arranged one above another, and a stapler and a chuck unit which are movable up and down along the bins. Paper sheets distributed from a copier or similar image forming apparatus into each bin are gripped together by the chuck unit and then pulled out to such an extent that a portion thereof to be stapled protrude from the bin. In this condition, the end of the paper sheets is stapled and then returned to the original position on the bin. This prior art apparatus, however, has some problems left unsolved, as enumerated below.

(1) Paper sheets coming in from a copier or a printer, for example, are distributed face down to each bin of the paper handling apparatus in order of page. The stapler, therefore, drives a staple into such a stack of paper sheets from the underside of the stack. More specifically, the stapler is moved from one bin to another while being held in an upside-down position. It follows that, when the stapler has run out of staples, one has to replace a staple cartridge from below the stapler by troublesome manipulations.

(2) The sorting section made up of the bins and sorting means and the binding section movable up and down along the bins for binding paper sheets distributed to the bins are constructed integrally with each other. This kind of construction invites an increase in production cost and is, therefore, intrusive for a user who needs only a simple binding function or does not need the binding function. The paper handing apparatus having such a complicated construction needs much time and labor for maintenance which will be performed at the time of production or failure. Hence, not only production efficiency and the quality are lowered, but also the products suffer from scattering.

(3) The housing of the paper handling apparatus has a stapler door which is openable for the replacement of a staple cartridge, maintenance of the stapler unit and chuck unit, etc. Besides, the housing has a sorter door and a sorter top cover for implementing the maintenance and inspection of paper transport paths and the removal of a jamming sheet. When any one of such doors and covers is opened, a door switch associated with the door is turned off to cut off the power supply immediately. If the door is opened while the stapler is in operation, a motor driving the stapler is immediately turned off to interrupt the stapling operation. This often causes a staple to stop the stapler or to be bent itself or locks the stapler with a paper stack bit into the stapler.

SUMMARY OF THE INVENTION

It is therefore an object of the present invention to provide a paper handling apparatus which facilitates manipulations for maintenance and other purposes.

It is another object of the present invention to provide a paper handling apparatus which allows one to readily replace a staple cartridge even with a stapler of the type driving a staple from the underside of a paper stack.

It is another object of the present invention to provide a paper handling apparatus which is simple in construction, easy to produce and maintain, and inexpensive, despite that it has a sorting section and a binding section.

It is another object of the present invention to provide a paper handling apparatus which eliminates the stop of the stapler and other similar accidents when any one of doors of a housing is opened while a stapling operation is under way.

It is another object of the present invention to provide a generally improved paper handling apparatus.

In accordance with the present invention, a paper handling apparatus comprises a plurality of bins arranged one above another, and a stapler unit movable up and down along the plurality of bins for stapling an end portion of a stack of paper sheets having been received from an image forming apparatus, sorted and distributed to any one of the bins. The stapler unit is movable between and lockable at a stapling position for stapling the stack of paper sheets and a staple supply position for supplying staples.

Also, in accordance with the present invention, a paper handling apparatus comprises a plurality of bins arranged one above another, a storing unit comprising a distributing device for distributing paper sheets to the plurality of bins, and a binding unit movable up and down along the plurality of bins and comprising a stapler for binding stacks of paper sheets distributed to the plurality of bins. The binding unit is removable from the storing unit.

Further, in accordance with the present invention, a paper handling apparatus comprises a housing a plurality of bins arranged one above another, a paper moving device movable up and down along the plurality of bins for gripping an end portion of a stack of paper sheets received from an image forming apparatus, sorted and distributed to any one of the bins, pulling out the stack of paper sheets by a predetermined distance from the bin, and returning the stack of paper sheets into the bin, a stapler unit for stapling an end portion of the stack of paper sheets having been pulled out by the paper moving device, a stapler door provided on the housing at the front of a movable range of the stapler unit, and another door provided on the housing. The stapler unit continues, when another door is opened when the stapler unit is performing a stapling operation, the stapling operation until the stapling operation completes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
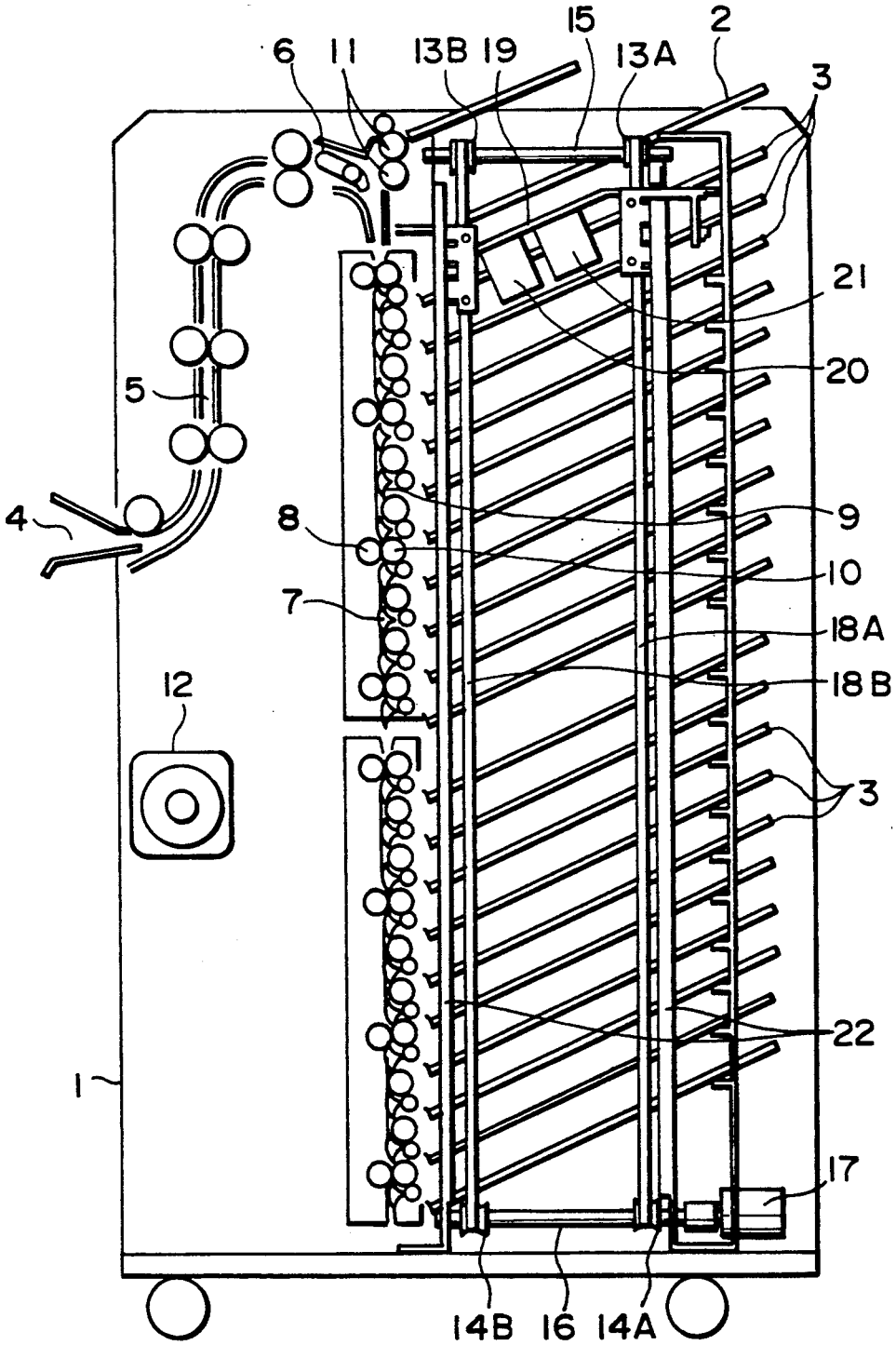
FIG. 1 PRIOR ART
FIG. 1 is a sectional side elevation schematically showing a specific construction of a prior art paper handling apparatus having a sorter with a stapler.

To better understand the present invention, a reference will be made to a prior art paper handling apparatus, shown in FIG. 1. The apparatus shown in FIG. 1 is implemented as the prior art apparatus disclosed in previously mentioned Japanese Patent Laid-Open Publication No. 57-63561 by way of example. As shown, the apparatus has a sorter which includes a housing 1. A discharge tray 2 is located at the uppermost position in the housing 1. A plurality of, twenty in this specific construction, bins 3 are arranged one above another at predetermined intervals below the discharge tray 2. The discharge tray 2 and bins 3 are parallel to each other and extend obliquely upward toward the outside of the housing 1. A paper transport path 5 terminates at a paper inlet 4 at which paper sheets from a copier, for example, will arrive. A selector in the form of a pawl 6 is located on the paper transport path 5 in the vicinity of the upper end of the apparatus. The selector 6 is movable to select either one of a path extending toward the discharge tray 2 and a paper transport path 7 which extends vertically along the paper inlet side of the bins 3. Transport roller pairs 8 are arranged one above another and at suitable intervals on the vertical paper transport path 7. A deflector also implemented as a pawl 9 and a discharge roller pair 10 are located in a particular position on the vertical path 7 where they face the inlet of any one of the bins 3. A discharge roller pair 11 is positioned on the path which terminates at the discharge tray 2. The transport rollers and discharge rollers mentioned above are driven by a motor 12. Shafts 15 and 16 carrying pulleys 13A and 13B and pulleys 14A and 14B, respectively, are journalled to the framework of the apparatus. The upper and lower shafts 15 and 16 are located at the front of the group of bins 3, i.e., at the viewer's side with respect to the sheet surface of FIG. 1. The pulleys 13A and 14A and the pulleys 13B and 14B are vertically aligned with each other. A motor 17 is drivably connected to the lower shaft 16. A belt 18A is passed over the aligned pulleys 13A and 14A, while a belt 18B is passed over the aligned pulleys 13B and 14B. A bracket 19 is anchored at opposite ends thereof to one run of the belts 18A and 18B which is located at the front side. The bracket 19 is inclined by the same angle as the bins 3. A stapler unit 20 and a chuck unit 21 are mounted on the underside of the bracket 19. Guide rollers are rollably mounted on opposite sides of the bracket 19, while channel-like guide rails 22 for guiding the guide rollers are located at the front of the bins 3. Specifically, the rollers are rollably received in the guide rails 22 which extend over substantially the entire height of the sorter.

Figure 2:
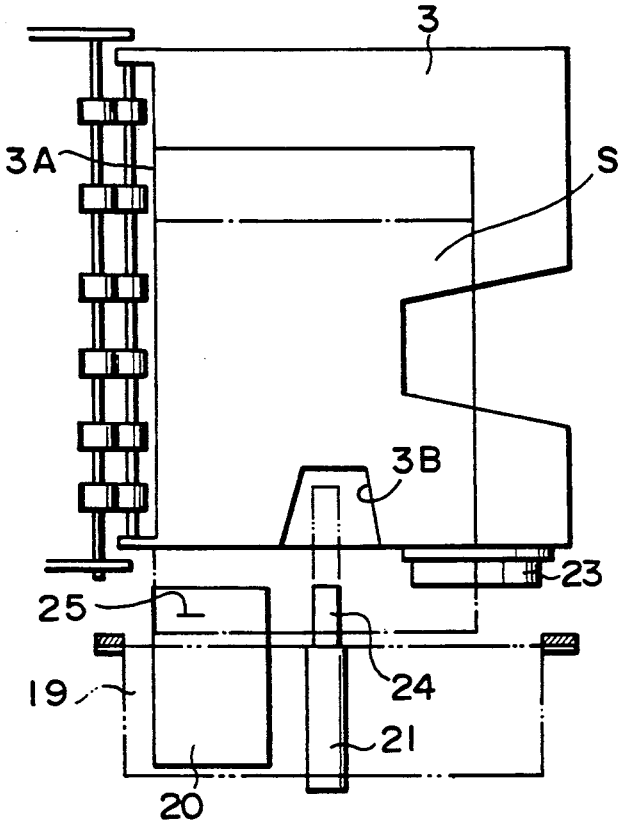
FIG. 2 PRIOR ART
FIG. 2 is a plan view of a bin, a stapler and a chuck unit included in the apparatus of FIG. 1.

A paper sheet driven out of the copier and reaching the paper inlet 4 advances along the paper transport path 5. When an ordinary paper discharge mode is selected, the selector 6 steers the paper sheet toward the discharge tray 2. On the other hand, when a sorter mode (sorting in order of page) or a stack mode (sorting page by page) is selected, the selector 6 steers the paper sheet to the vertical paper transport path 7. The deflectors 9 and discharge roller pairs 10 each being associated with respective one of the bins 3 are actuated in matching relation to the sorter mode or the stack mode, whereby paper sheets are distributed to the individual bins 3. As shown in FIG. 2, an abutment 3A extends upward from the paper inlet end of each bin 3, while a retractable bin fence 23 extends upright from the front end of each bin 3. Hence, paper sheets distributed to any one of the bins 3 are sequentially stacked by being abutted against the abutment 3A and bin fence 23 by the inclination of the bin and a presser, not shown.

Assume that a staple mode for stapling paper stacks loaded on the individual bins is selected. Then, as shown in FIG. 2, the motor 17 is energized to move the bracket 19 which carries the stapler unit 20 and chuck unit 21 therewith sequentially to the successive bins 3. After the bracket 19 has been located at any one of the bins 3, a chuck 24 included in the chuck unit 21 is extended toward the bin 3 until it reaches a notched portion 3B of the bin 3. The chuck 24 chucks the stack at the notched potion 3B and then pulls it out to a position which is indicated by a dash-and-dot line in FIG. 2. At this instant, the bin fence 23 is urged by the end of the paper stack to its retracted position. A front left portion of the paper stack having been pulled out of the bin 3 is received in a recess of the stapler unit 20. In response to a staple signal, a solenoid associated with the stapler unit 20 is energized to activate the stapler 20 so as to staple the stack at one corner 25 of the latter. Subsequently, the chuck 24 is again extended toward the bin 3 to return the stapled paper stack into the bin 3, opened to release the stack, an then retracted to a position indicated by a solid line in the figure. Thereupon, the bracket 19 is moved to another bin.

Figure 3:
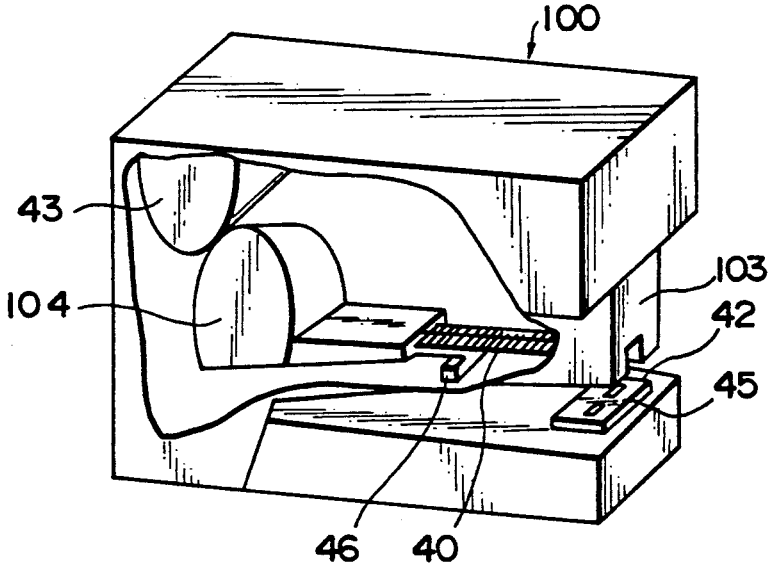
FIG. 3 PRIOR ART
FIG. 3 is a perspective view showing a specific construction of the stapler of the prior art apparatus.

Referring to FIG. 3, a stapler 100 built in the stapler unit 20 is shown. The stapler 100 is loaded with a stapler cartridge 104. Staples 40 are tied together in a band configuration by a thin tape with their opposite portions to form bent legs being straightened. The band of staples 40 is rolled up and received in the staple cartridge 104. Biasing means, not shown, maintains the leading staple 40 in a position where it faces a stapling position 42. When a motor 43 is energized by an electric signal, a stapling section 103 located above the stapling position 42 bends opposite ends of the leading staple 40 of the staple band in the form of a letter U and presses it downward. As a result, the legs of the staple 40 penetrate a paper stack and are then bent inward while being guided by recesses which are provided on a receiving section 45 located below the stapling position 42. Subsequently, the motor 43 is turned off while the stapling section 103 is raised away from the stapling position 42. When a near-end sensor 46 senses the last staple 40 on the tape, a near-end signal is produced to turn on a display for urging one to replace the staple cartridge 104. The near-end sensor 46 may be implemented by a reflection type photoelectric sensor.

A number of paper sheets driven out of a copier, printer or similar image forming apparatus are often distributed face down to each bin of a paper handling apparatus in order of page. To bind such stacks of paper sheets by a stapler, it is necessary that the stapler drives a staple into the paper stack from the underside of the stack. More specifically, the stapler is moved from one bin to another while being held in an upside-down position. If follows that, when the stapler has run out of staples, one has to replace a staple cartridge from below the stapler by troublesome manipulations.

The sorting section made up of the bins and sorting means and the binding section movable up and down along the bins for binding paper sheets distributed to the bins are constructed integrally with each other, as stated above. This kind of construction invites an increase in production cost and is, therefore, intrusive for a user who needs only a simple binding function or does not need the binding function. The paper handling apparatus having such a complicated construction needs much time and labor for maintenance which will be performed at the time of production or failure. Hence, not only production efficiency and the quality are lowered, but also the products suffer from scattering.

Figure 4:
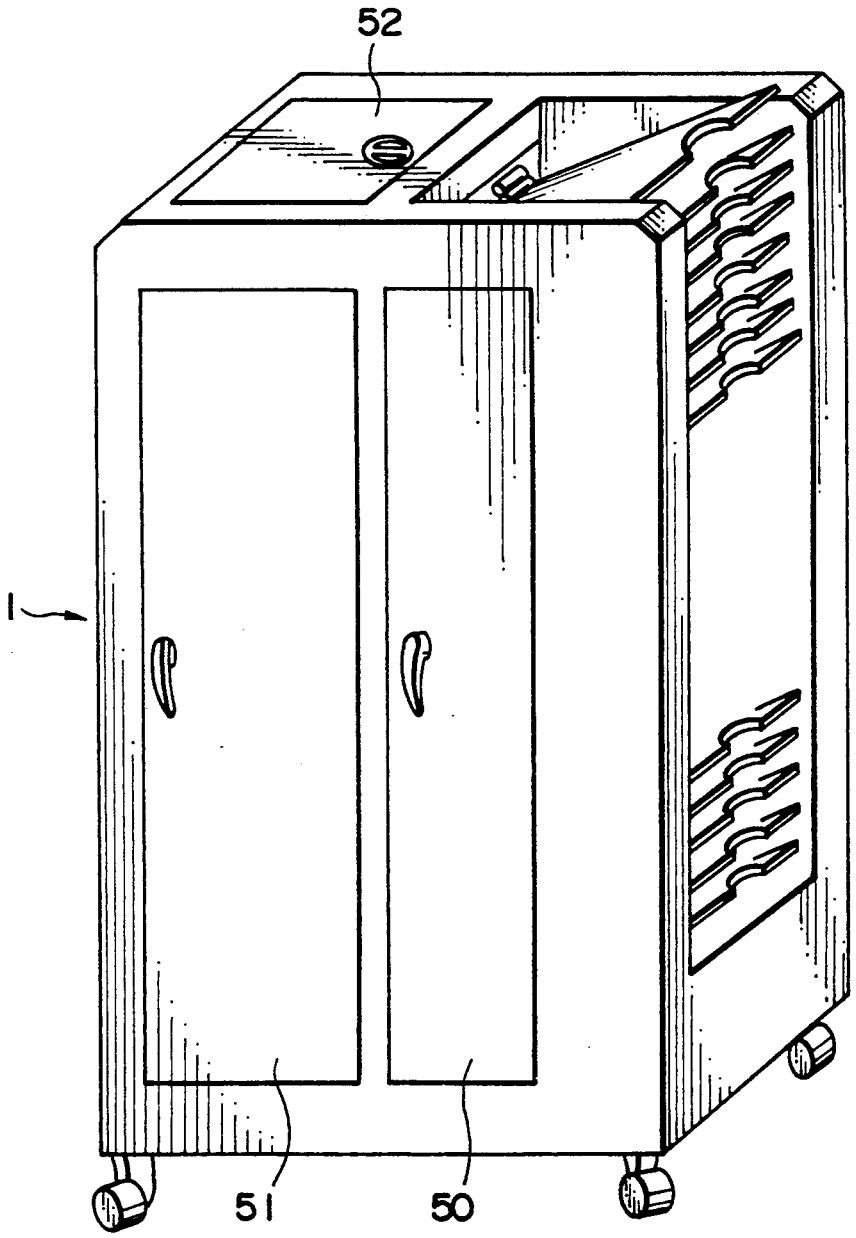
FIG. 4 is a perspective view of the prior art apparatus shown in FIG. 1.

As shown in FIG. 4, the housing 1 of the sorter has a stapler door 50 which is openable for the replacement of a stapler cartridge, maintenance of the stapler unit and chuck unit, etc. The stapler door 50 is positioned on the front end of the housing 1 as viewed from the operator's side and extends over a movable range of the stapler unit and chuck unit. Besides, the housing 1 has a sorter door 51 at the front end thereof and a sorter top cover 52 at the top for implementing the maintenance and inspection of paper transport paths and the removal of a jamming sheet. A copier, printer, sorter or similar office equipment is constructed such that when any one of such doors and covers is opened, a door switch associated with the door is turned off to cut of the power supply immediately so as to deenergize motors. This is successful in enhancing safety operations. Regarding a sorter in which a stapler is driven by a motor for binding paper stacks as stated previously, opening the door causes all the motors to be stopped. If the door is opened while the stapler is in operation, the motor driving the stapler is turned off immediately to interrupt the stapling operation. This often causes a staple to stop the stapler or to be bent itself or locks the stapler with a paper stack bit into the stapler.

Preferred embodiments of the paper handling apparatus in accordance with the present invention will be described which is free from the drawbacks particular to the prior art as discussed above.

Referring to FIGS. 5 to 9, there is shown a specific construction of a stapler unit included in the illustrative embodiment. The stapler unit, generally 20, is mounted on the underside of a bracket 19 which is movable up and down along a group of bins 3, as shown in FIGS. 1 and 2. The position of the stapler unit 20 is opposite to the position shown in FIG. 3 as viewed in the vertical direction. While a stapler built in the stapler unit 20 shown in FIGS. 5 to 9 is constructed and operated in the same manner as the stapler 100 shown in FIG. 3, individual members constituting the stapler are somewhat different in configuration.

Figure 5:
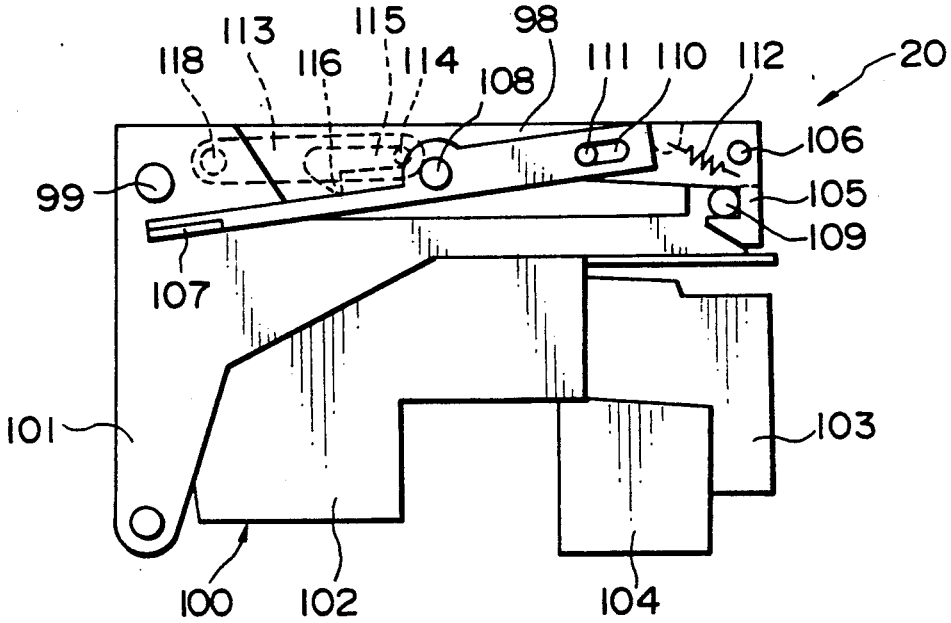
FIGS. 5 to 9 are views showing a stapler unit representative of an embodiment of the paper handling apparatus in accordance with the present invention in a sequence of stages for replacing a staple cartridge.
Figure 6:
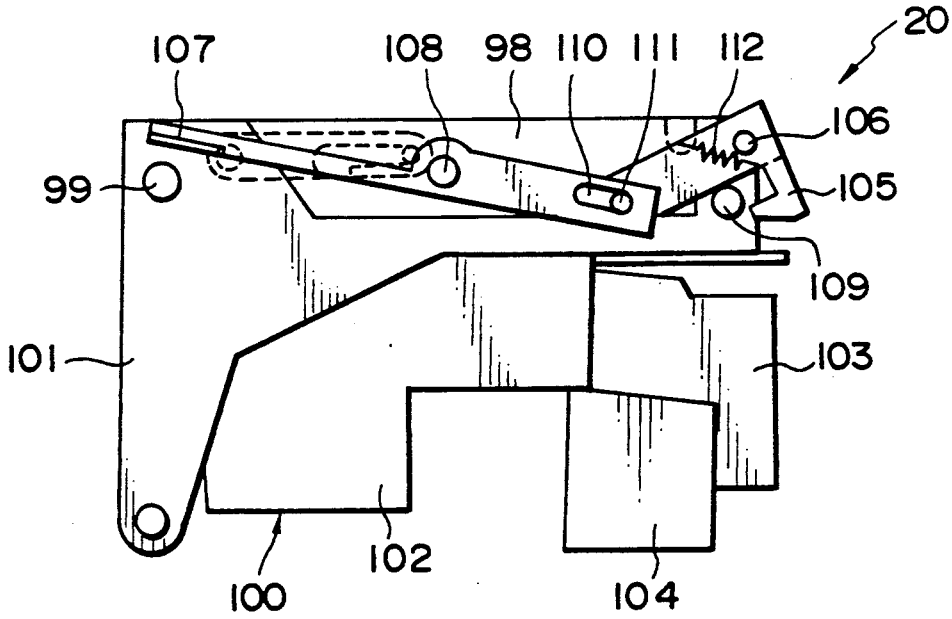
Figure 7:
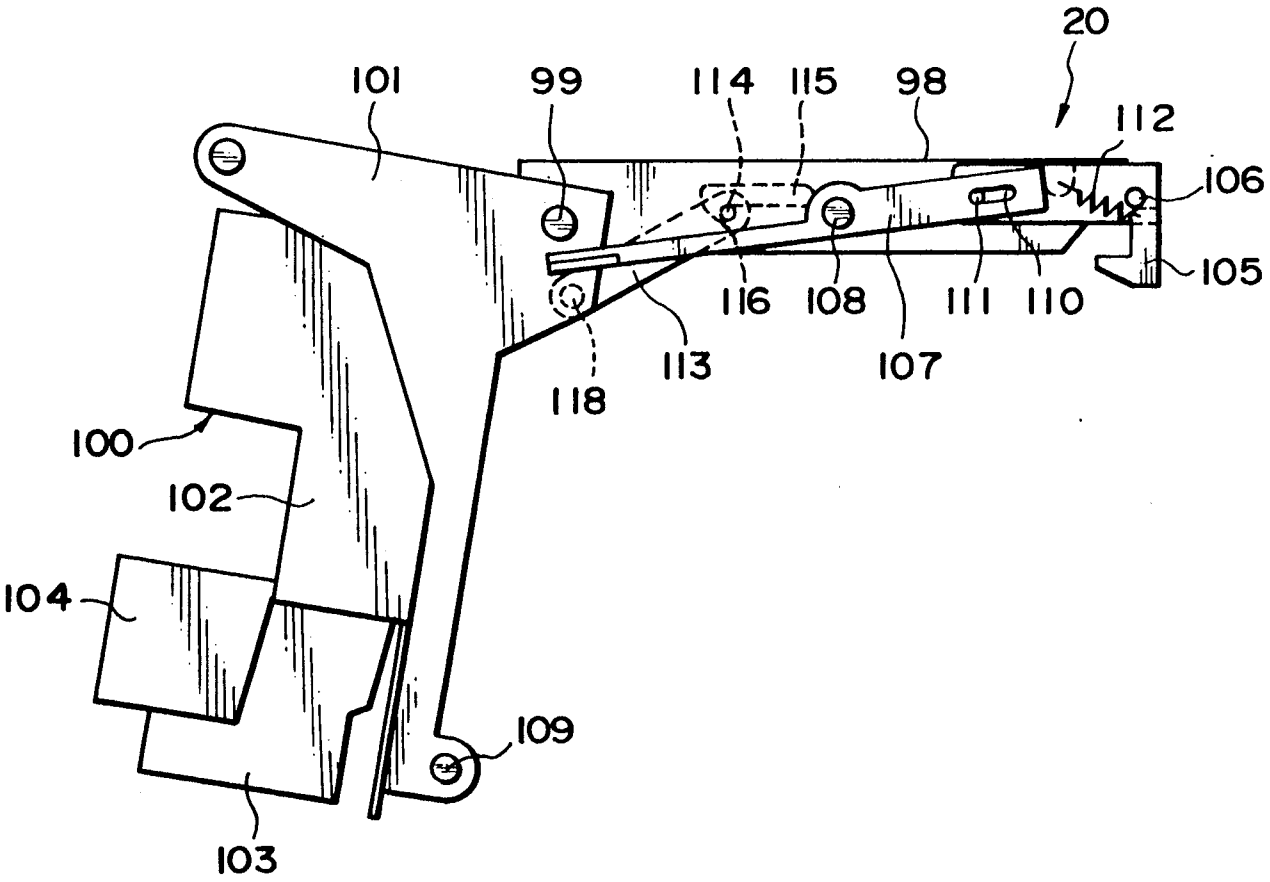

As shown in FIG. 5, the stapler unit 20 positioned upside down has a support 98 affixed to the bracket 19, and a stapler 100 rotatably mounted on the base 98 by a shaft 99. The stapler 100 is made up of a base 101 rotatably supported by the shaft 99, a body 102 rigidly mounted on the base 101, a stapling section 103, and a replaceable staple cartridge 104. A pawl 105 and a lever 107 are rotatably mounted on the support 98 by shafts 106 and 108, respectively. A pin 109 is studded on the base 101 of the stapler 101 in such a manner as to engage with the pawl 105 in an operative position shown in FIG. 5. One end of the lever 107 is connected to one end of the pawl 105. Specifically, an elongate slot 110 is formed through the lever 107 while a pin 111 is studded on the pawl 105 and received in the slot 110, so that an angular movement of the lever 107 may be transmitted to the pawl 105. Of course, the slot 110 and pin 111 of the lever 107 and pawl 105, respectively, may be replaced with each other. A spring 112 is preloaded between the pawl 105 and the support 98 to constantly bias the pawl 105 to a position where it engages with the pin 109. In the position shown in FIG. 5, the pawl 105 is engaged with the pin 109 to hold the stapler 100 in the operative position. When a person raises the lever 107 to a position shown in FIG. 6, the pawl 105 releases the pin 109. As a result, the stapler 100 is rotated 90 degrees about the shaft 99 by gravity or by hand to a staple supply position which is shown in FIG. 7.

A lever 113 is rotatably connected to the base 101 of the stapler 100 by a shaft 118. A pin 114 is studded on the free end of the lever 113 and received in a cam slot (or cam groove) 115 which is formed through the support 98. A locking recess 116 is formed in the support 98 and contiguous with the cam slot 115. In the staple position shown in FIG. 7, the pin 114 drops into the locking recess 116 resulting in the stapler 100 being locked in the stapler supply position. When the lever 107 is released after the stapler 100 has moved away from the operative position as stated above, the pawl 105 regains the original position under the action of the spring 112 and, therefore, the lever 107 is restored as shown in FIG. 7. In the position shown in FIG. 7, the lever 107 is located below the locking recess 116 while the pin 114 is located above the lever 107. In such a staple supply position, the stapler 100 is almost protruded to the outside of the side bracket of the sorter to facilitate the replacement of the staple cartridge 104.

Figure 8:
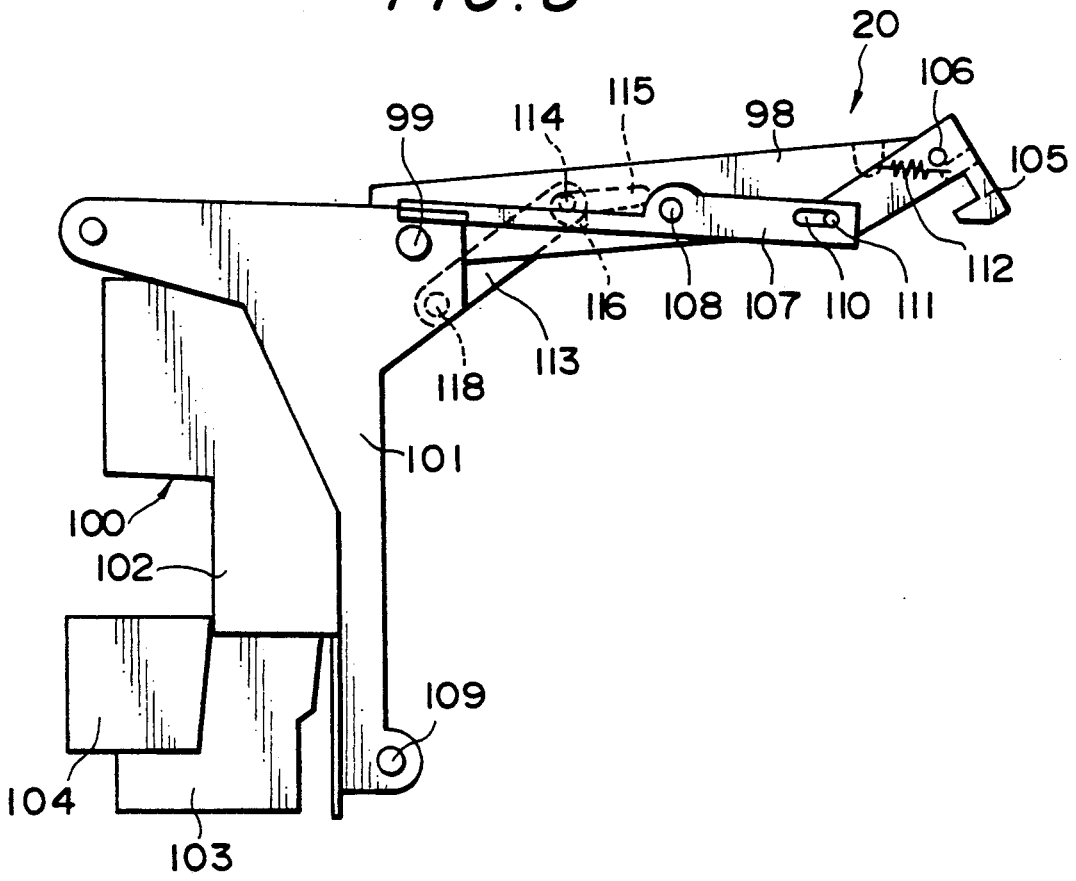
Figure 9:
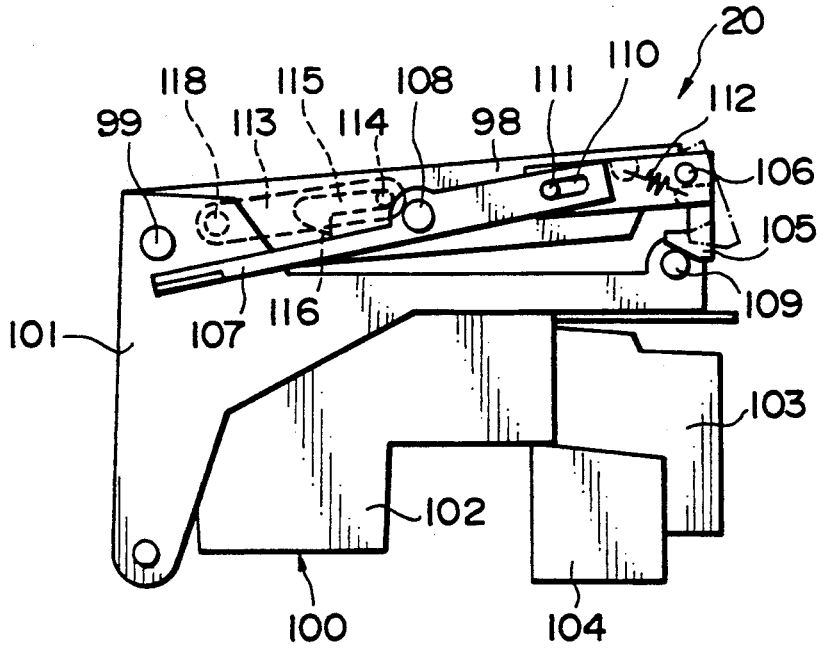

After the replacement of the staple cartridge 104, the lever 107 is raised to a position shown in FIG. 8. Then, the pin 114 is urged upward by the upper edge of the lever 107 and thereby released from the locking recess 116, whereby the stapler 100 is allowed to rotate freely about the shaft 99. As soon as the lever 107 is released, the pawl 105 is restored by the spring 112. The stapler 100 is rotated counterclockwise as viewed in the figures to the operative position either by hand or by suitable returning means. At this instant, as shown in FIG. 9, the pin 109 abuts against the pawl 105 and, by cooperating with a slant of the pawl 105, urges the pawl 105 outward to a position indicated by a phantom line in the figure. Then, the pin 109 is again engaged with the pawl 105 by the spring 112.

As stated above, the stapler 100 is movable between the operative position for stapling a paper stack and the staple supply position for replacing a staple cartridge, facilitating the replacement of a staple cartridge. Easy replacement of a staple cartridge is further promoted because the stapler 100 is tiltable in the up-and-down direction to the staple supply position where it protrudes to the outside.

Figure 10:
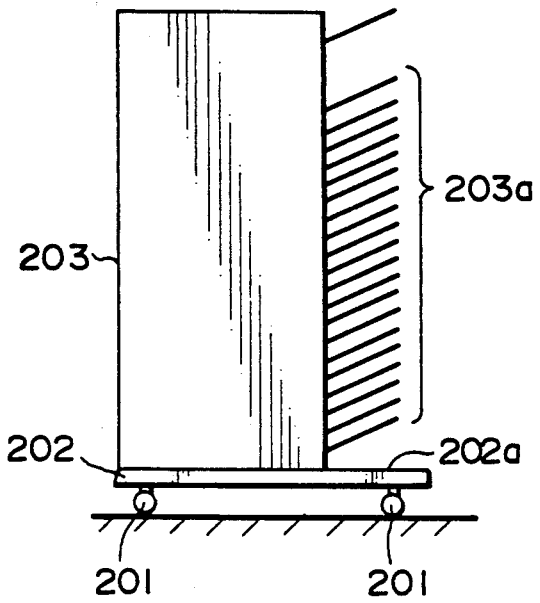
FIG. 10 is a front view of a sorting unit applicable to a preferred embodiment of the paper handling apparatus in accordance with the present invention.
Figure 11:
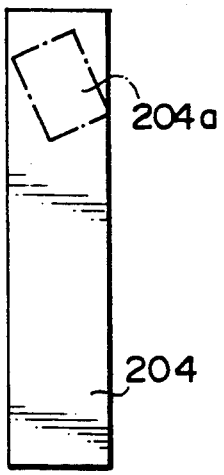
FIG. 11 is a front view of a binding section also applicable to the embodiment of the present invention.
Figure 12:
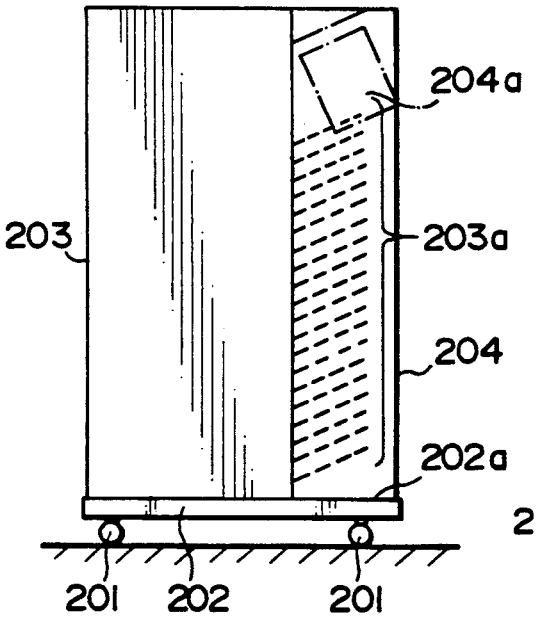
FIG. 12 is a front view which is the combination of FIGS. 10 and 11.
Figure 13:
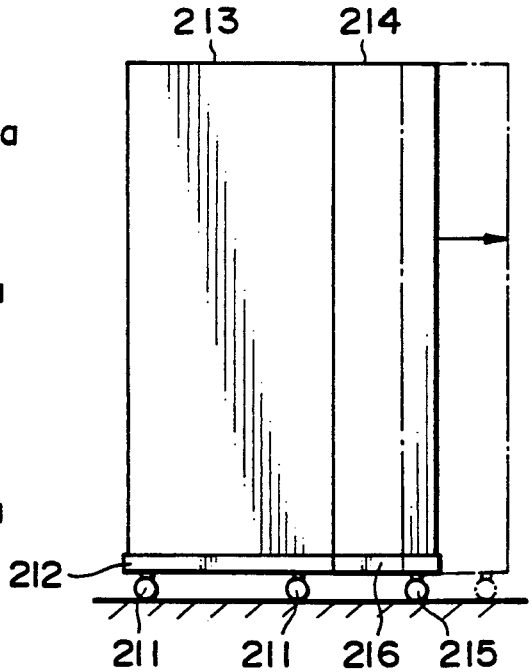
FIG. 13 is a view of a binding section representative of an alternative embodiment of the present invention and which is shown in an uncoupled position.
Figure 14:
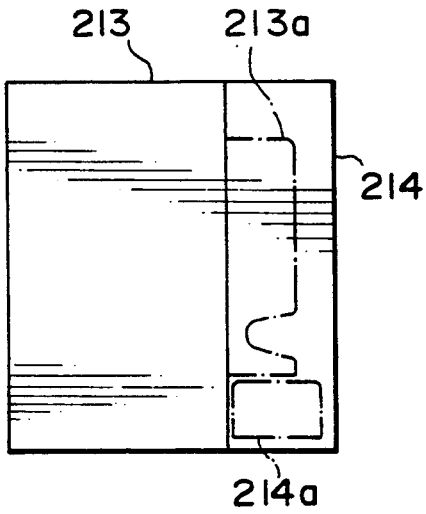
FIG. 14 is a plan view showing the binding section of FIG. 14 in a coupled position.

Referring to FIGS. 10 to 12, a paper handling apparatus embodying the present invention is shown which is loaded with the stapler unit 20 having the above construction. As shown, a sorting unit 203 is securely mounted on a mount 202 which is provided with casters 201. The sorting unit 203 has multiple bins **203*a* which are arranged one above another. A space 202*a* is available on the mount 202 at the right of the sorting unit 203 for mounting a binding section 204 which has a binding implement 204*a*. The binding section 204 may be mounted in the space 202*a* and combined with the sorting unit 203, as shown in FIG. 12**.

Figure 15:
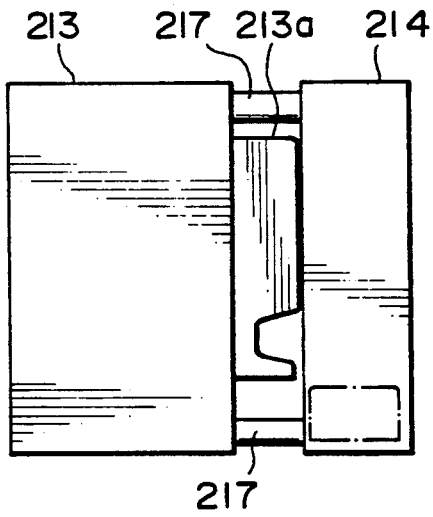
FIG. 15 is a plan view showing the binding section of FIG. 13 in the uncoupled position.
Figure 16:
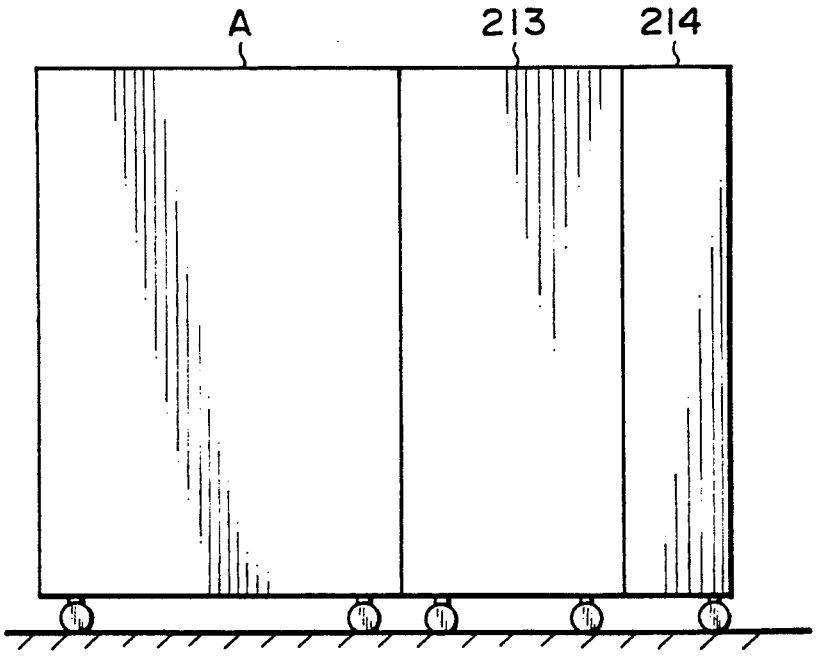
FIG. 16 is a front view of the illustrative embodiment combined with a copier.

FIGS. 13 to 16 show an alternative embodiment of the present invention. As shown, a sorting unit 213 is fixed on a mount 212 having casters 211 while a binding section 214 is fixed on a mount 216 having casters 215. The mounts 212 and 216 may be abutted against each other to combine the sorting unit 213 and the binding section 214. Then, in the event of maintenance, the mount 216 with the binding section 214 will be moved away from the mount 212 with the sorting unit 213. In FIG. 15, the reference numeral 217 designates a guide rod. In FIG. 16, alphabet A designates a copier body. Such a binding unit removable from a sorting unit not only broadens the selectable range of products but also enhances efficient production and maintenance.

An alternative embodiment of the present invention will be described in detail with reference to FIGS. 1, 2 and 4 showing the sorter 1.

As shown in FIG. 4, the stapler door 50 is positioned on the front wall of the housing of the sorter 1 as viewed from the operator's side and extends over the movable range of the stapler unit 20 and chuck unit 21. The sorter door 51 and sorter top cover 52 are respectively positioned on the front wall and the top wall of the sorter housing in order to facilitate the maintenance and inspection of various components and structural elements as well as the removal of a jamming sheet. A sensor or door switch, not shown, is associated with each of the doors 50, 51 and 52 for sensing open and closed positions of the door. The illustrative embodiment is controlled as follows. Specifically, when the staple door 50 is opened as sensed by the sensor while a stapling operation is under way, the stapling operation is stopped immediately. However, when a door other than the staple door, i.e., the sorter door 51 or the sorter top cover 52 is opened while a stapling operation is under way, the stapling operation is continued until it completes. When the sorter door 51 or the sorter top cover 52 is opened while the chuck 24 (FIG. 2) of the chuck unit 21 is moved forward, the chuck motor associated with the chuck 24 is turned off and no stapling operations are performed. Further, when the sorter door 51 or the sorter top cover 52 is opened while the chuck unit 24 is moved backward with a paper stack, the stapling operation is continued until that paper stack has been stapled.

As stated above, when a door other than the stapler door 50 is opened during a stapling operation, the stapling operation is continued until it completes. This is successful in prevening the stapler from being stopped by a staple. Stopping the stapling operation when the stapler door 50 is opened is desirable from the safety operation standpoint.

A specific operation of the illustrative embodiments of the present invention will be described with reference to FIGS. 17 to 20.

To facilitate an understanding of the operation of the present invention, the stapling operation of the prior art paper handling apparatus shown in FIG. 1 will be described first. In the prior art apparatus implemented as the sorter 1, stacks of paper sheets distributed to the bins 3 are sequentially stapled from the top to the bottom. When a staple start command from an image forming apparatus is received, an elevator (bracket 19, FIG. 1) loaded with the stapler unit 20 is shifted to the bin which is loaded with a paper stack to be stapled first.

Figure 17:
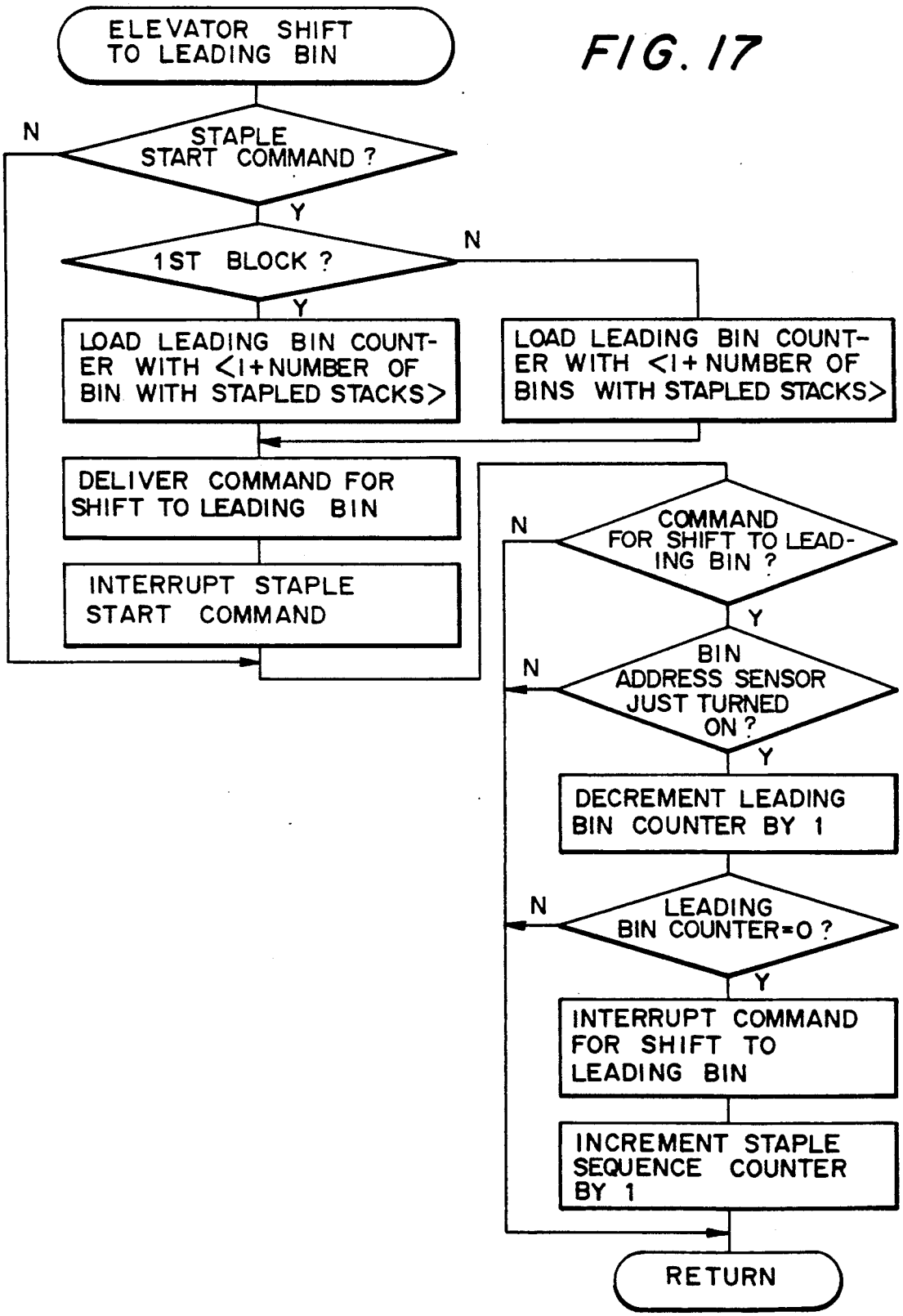
FIG. 17 is a flowchart demonstrating a sequence of steps for moving an elevator to a leading bin when any one of the illustrative embodiments performs a stapling operation.

Specifically, as shown in FIG. 17, a particular bin at which the stapling operation should begin is determined in response to a staple start command. The sorter 1 has twenty bins 3 which are divided into a first or upper block and a second or lower block each having ten bins 3. First, which of the first and second blocks is loaded with paper stacks to be stapled is determined. If the first block is loaded with such paper stacks, "1+number of bins with stapled stacks" is inputted in a leading bin counter which is indicative of a bin at which the stapling operation should begin. At the same time, a shift command for commanding a shift to the leading bin is delivered. The words "number of bins with stapled stacks" mean the number of bins whose paper sheets have already been stapled and is indicated by a stapled stack counter. This counter is reset to 0 when all the paper stacks have been bound by a single set of stapling operations or when the stapling mode is replaced with another mode. The stapled stack counter is not cleared in response to a jam signal, a cover/door open signal, and a staple interrupt command from the image forming apparatus. Hence, when the next staple start command arrives, the stapling operation is resumed from the uppermost one of the bins with non-stapled stacks by skipping the bins with stapled stacks.

In response to the shift command, an elevator motor (motor 17, FIG. 1) is turned on to lower the stapler 20. As the stapler 20 is lowered, a bin address sensor sequentially senses exclusive pieces each being associated with respective one of the bins 3. When the bin address sensor is just turned on, the leading bin counter is decremented by 1. As soon as the leading bin counter reaches 0, the shift command is interrupted and the elevator motor is turned off. As a result, the stapler is stopped at the position where the leading bin is located. Then, 1 is inputted in a staple sequence counter to start a stapling operation.

Figures 1, 2, 3, 18A:
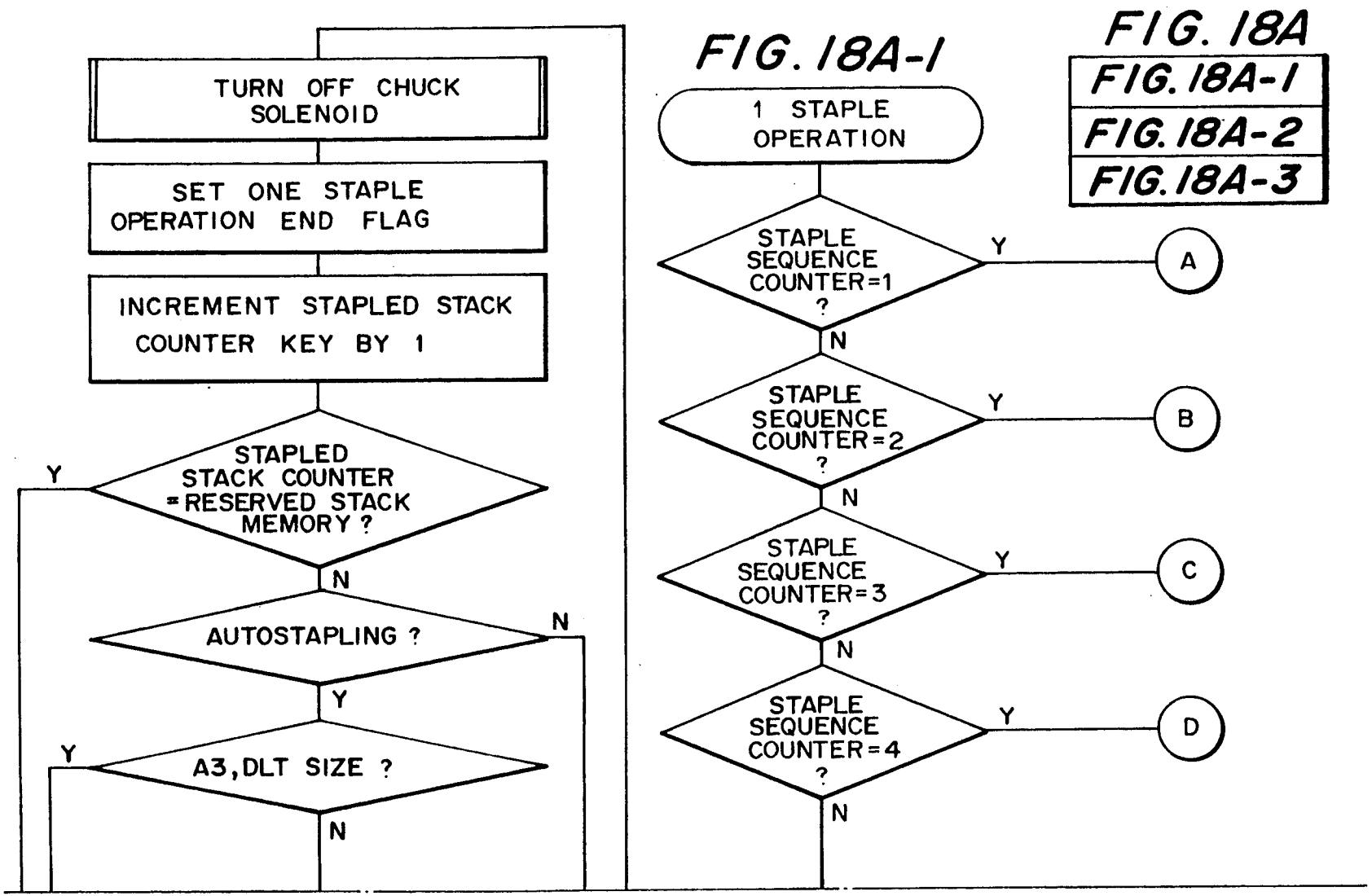
FIGS. 18*a* and 18*b* are flowcharts representative of a stapling operation of any one of the illustrative embodiments.
Figures 2, 18A:
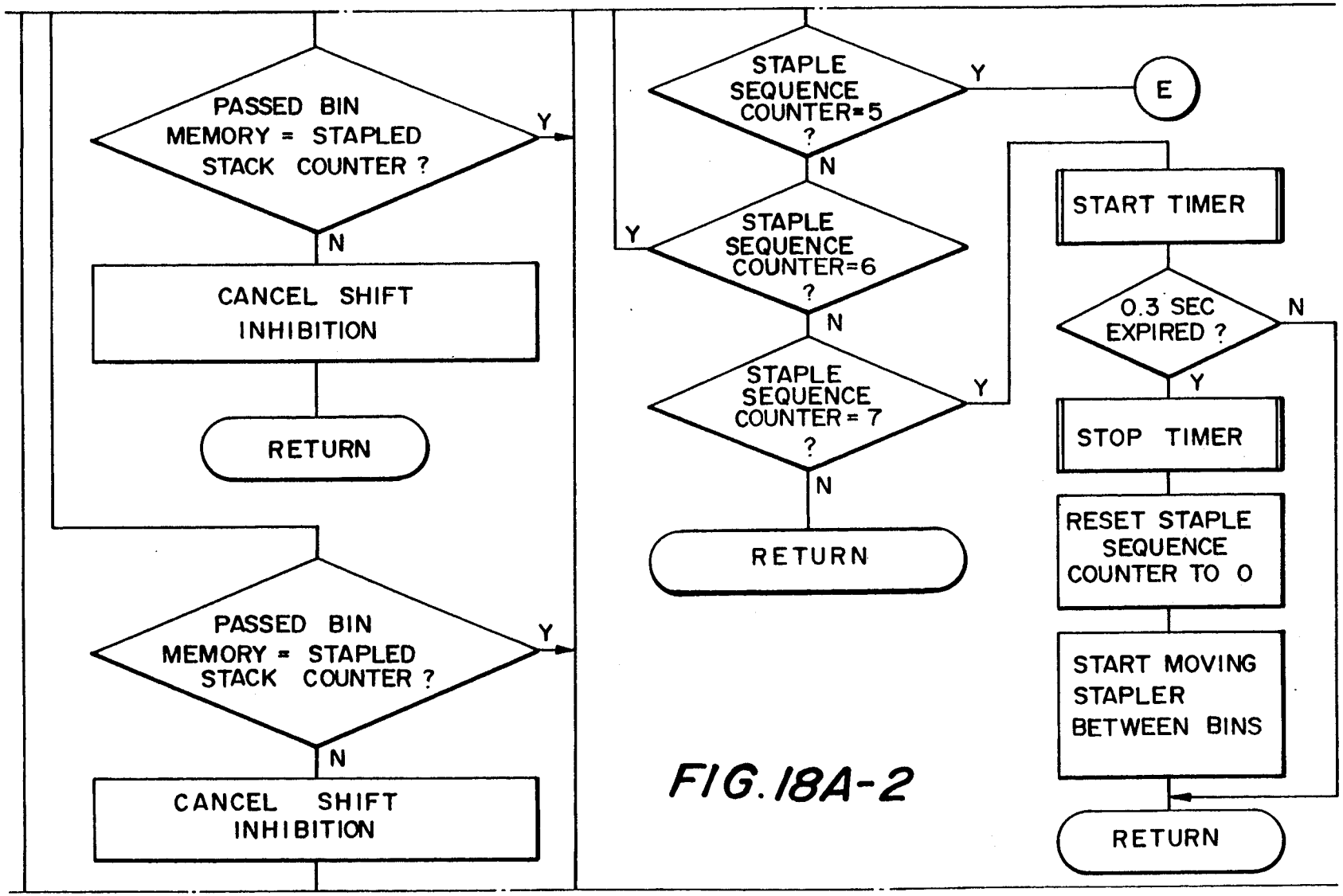
Figures 3, 18A:
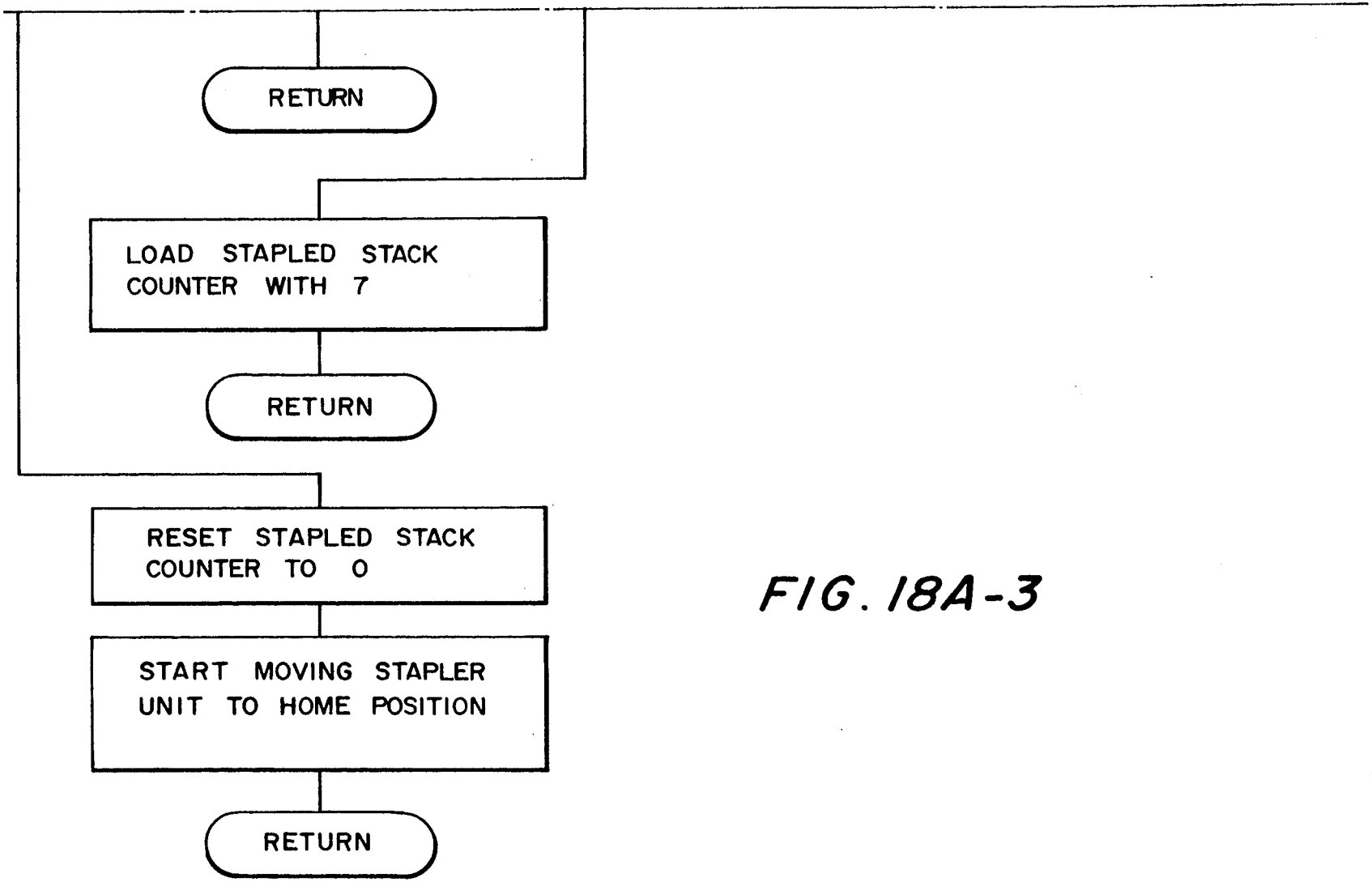
Figure 18B:
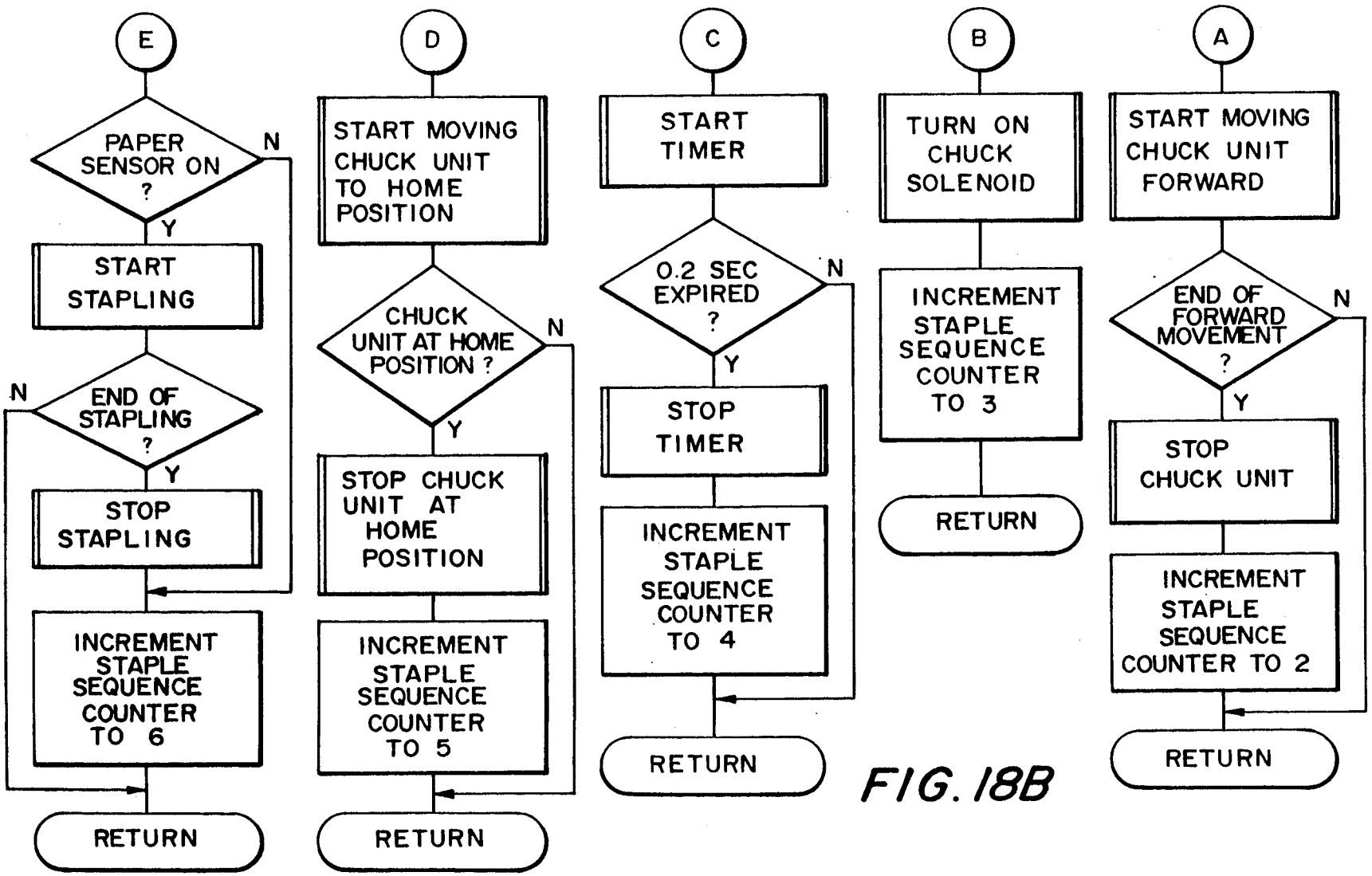

Referring to FIGS. 18A and 18B, a single stapling procedure will be described. When the stapler reaches the leading bin, the staple sequence counter is incremented from 0 to 1. When the staple sequence counter is 1, the chuck motor is energized to move the chuck 24 (FIG. 2) of the chuck unit 21 forward. When a pre-chuck sensor responsive to the end of the forward movement of the chuck unit 21 is turned on, the chuck unit 21 is brought to a stop while the staple sequence counter is incremented to 2. When the staple sequence counter is 2, the chuck solenoid is turned on to cause the chuck 24 to grip a paper stack and the staple sequence counter is loaded with 3. When the staple sequence counter is 3, the current state is held for 0.2 second and, on the lapse of 0.2 second, the staple sequence counter is incremented to 4. When the staple sequence counter is 4, the chuck motor is turned on to move the chuck unit 21 to the home position. When a post-chuck sensor responsive to the arrival of the chuck unit 21 at the home position is turned on, the chuck unit is again brought to a stop and the staple sequence counter is incremented to 5. When the staple sequence counter is 5, whether the output of a paper sensor is indicative of the presence of a paper stack. If it indicates the presence of a paper stack, the stapler performs a stapling operation. When the end of the stapling action is detected, the staple sequence counter 6 is incremented to 6. If a paper stack is absent, the stapling operation is skipped.

When the staple sequence counter is 6, the chuck solenoid is deenergized, the stapled stack counter is incremented, and a shift motor is energized. Then, the stapled stack counter is compared with a reserved stack memory indicative of the total number of bins storing paper stacks to be stapled. If the former equals the latter, the staple sequence counter is reset to 0 and the stapling procedure is terminated. Thereafter, the elevator motor 17 is turned on to return the stapler unit 21 to its home position. If the stapled stack counter is smaller than the reserved stack counter, the staple sequence counter is incremented to 7. When the staple sequence counter is 7, the current state is held for 0.3 second and, on the lapse of 0.3 second, a command is delivered for moving the stapler to the next bin on the basis of a subroutine shown in FIG. 19.

Figure 19:
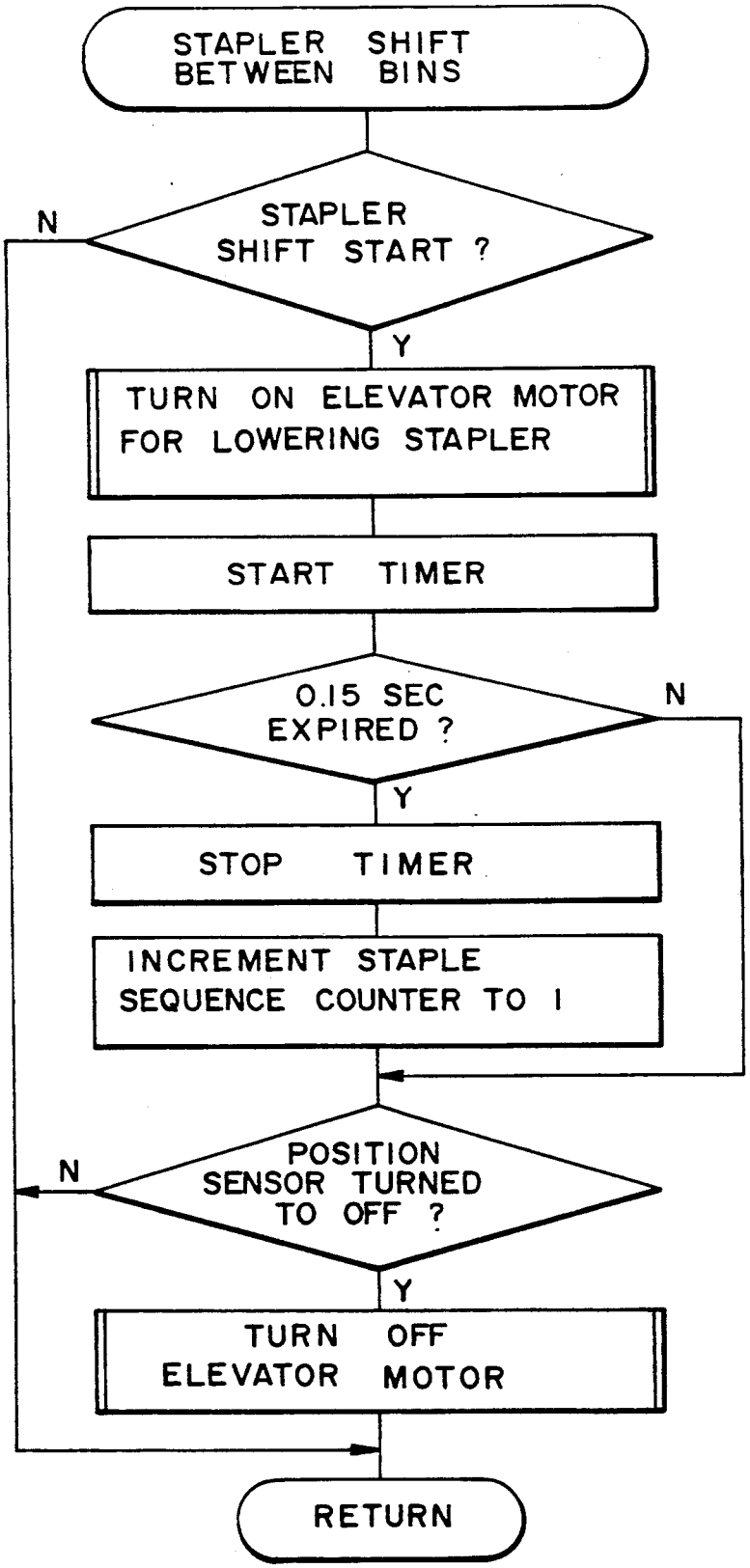
FIG. 19 is a flowchart showing a procedure for moving the stapler of any one of the illustrative embodiments between bins.

In FIG. 19, when the stapler shift command is delivered, the elevator motor 17 is turned on while a timer is started. When a predetermined period of time expires as counted by the timer, the staple sequence counter is incremented to 1 to start a stapling operation for the next bin. When an elevation position sensor is turned on, the elevator motor is turned off to end the shift of the stapler between the bins. In the illustrative embodiment, the stapling operation for the next bin begins about 100 milliseconds before the end of movement of the stapler to that bin, thereby reducing the stapling time. The procedure described above is repeated until the stapled stack counter equals the reserved stack counter. So long as the stapler door 50, sorter door 51 and sorter top cover 52 are closed, the stapling operation is continued.

Figures 20, 20A, 20B:
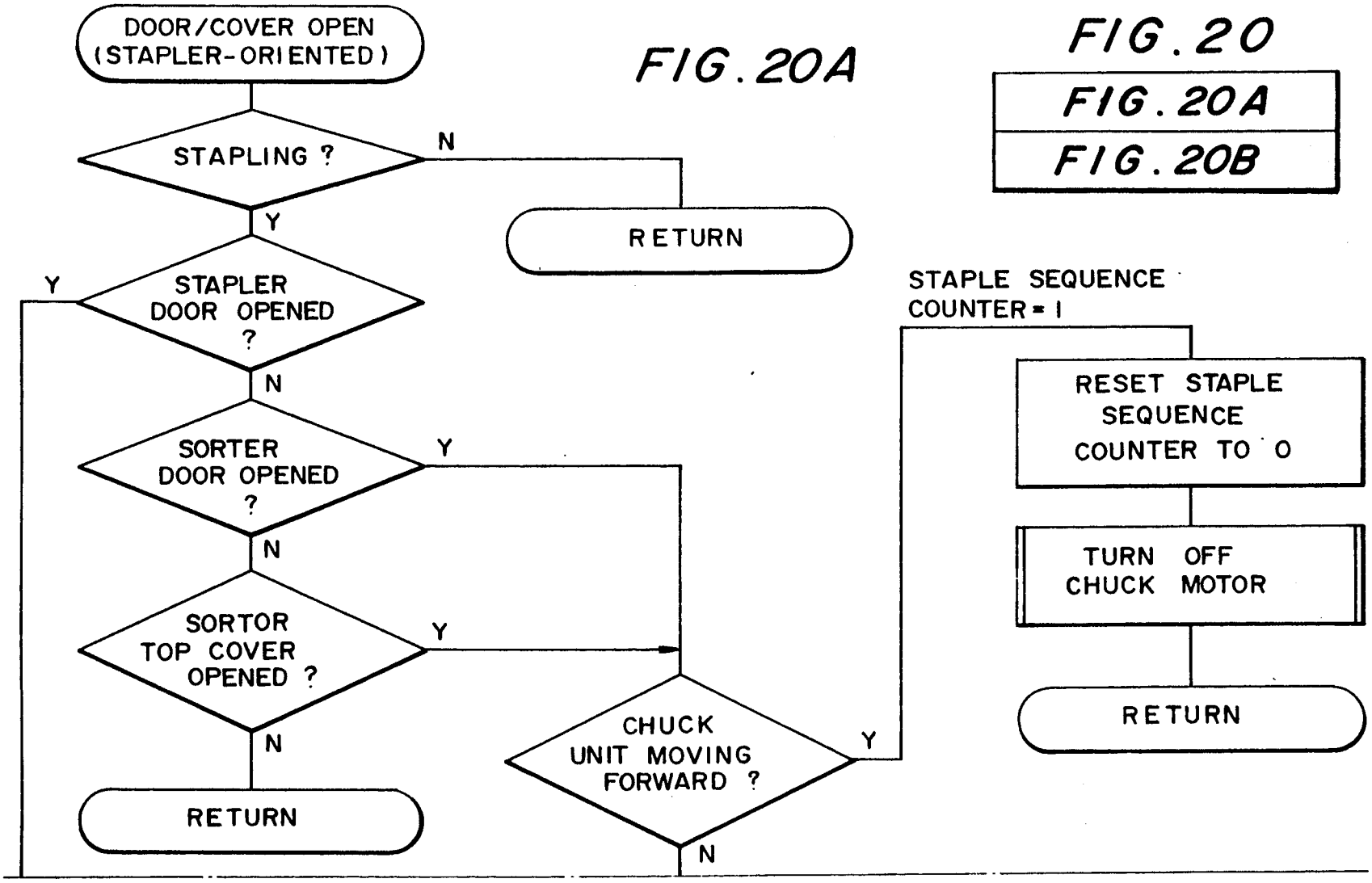
FIG. 20 is a flowchart showing how the stapler of any one of the illustrative embodiments is controlled when any one of doors and covers of a housing is opened.
Figure 20B:
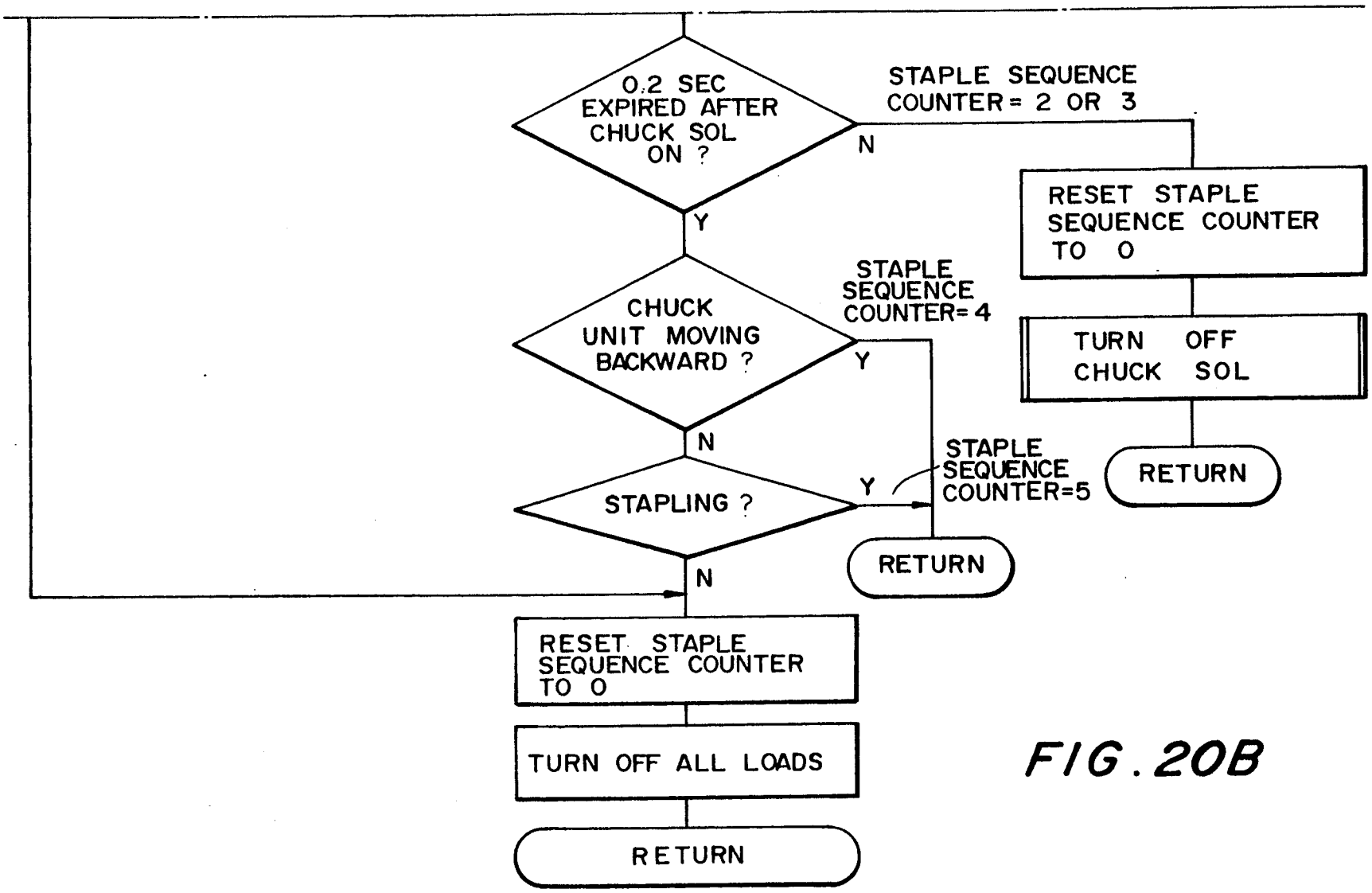

FIG. 20 shows a sequence of steps which are executed when any one of the doors and cover of the sorter housing is opened during a stapling operation. As shown, when the stapler door 50 is opened while a stapling operation is under way, the staple sequence counter is reset to 0 and all the loads are turned off. When the sorter door 51 or the sorter top cover 52 is opened with the stapler door 51 being closed (hereinafter referred to as a state 1), the following processing is executed.

In the state 1, if the chuck 24 of the chuck unit 21 (FIG. 2) is moving forward, the staple sequence counter is reset to 0 and the chuck motor is deenergized. In the state 1, if the chuck has already moved forward and 0.2 second has not expired yet after the turn-on of the chuck solenoid, the staple sequence counter is reset to 0 and the chuck solenoid is deenergized. In the state 1, if the chuck of the chuck unit 21 has already moved forward and 0.2 second has expired after the turn-on of the chuck solenoid (hereinafter referred to as a state 2), the following sequence procedure is executed.

In the state 2, if the chuck of the chuck unit 21 is moving backward, the staple sequence counter is incremented to 4 and the operation is continued. In the state 2, if the chuck of the chuck unit 21 has already moved backward and a stapling operation is under way, the staple sequence counter is incremented to 5 and the operation is continued. In the step 2, if the chuck of the chuck unit 21 has already moved backward and a stapling operation has ended, the staple sequence counter is reset to 0 and all the loads are turned off. Further, in the state 1, if the elevator motor is in rotation, the staple sequence counter is reset to 0 and all the loads are turned off.

In response to a staple interrupt command from the image forming apparatus, the sequence of steps which occur in response to opening of the sorter door 51 or the sorter top cover 52 as described above is also executed. Specifically, a stapling operation is completed, and then the elevator is raised to the home position.

While the illustrative embodiments of the present invention have concentrated on a sorter with a stapler shown in FIGS. 1 to 4, the present invention is of course applicable to other various kinds of sorters in which the drive of a stapler, the grip and pull-out of a paper stack from a bin and the return of the paper stack are executed electrically by a predetermined sequence. For example, each of the upper and lower chucks of the chuck unit may be movable. The pull-out and return of a paper stack may each occur at a lower speed at the start and end of a movement than at an intermediate portion.

In summary, in accordance with the present invention, a stapler is movable between an operative position for stapling a paper stack and a staple supply position for replacing a staple cartridge, thereby facilitating the replacement of a stapler cartridge. Especially, the stapler is tiltable downward to the staple supply position where it protrudes to the outside of a side bracket of a sorter, further promoting the ease of replacement of a staple cartridge. A binding unit is removable from a sorting unit to broaden the selectable range of products and to enhance efficient production and maintenance. Further, when a door or a cover other than a stapler door is opened while a stapling operation is under way, the stapler is not deactivated until the stapling operation completes. This eliminates various accidents such as the stapler being stopped by a staple.

Various modifications will become possible for those skilled in the art after receiving the teachings of the present disclosure without departing from the scope thereof.

What is claimed is:

1. A paper handling apparatus comprising:

a plurality of bins arranged one above another;

a sorting section comprising distributing and sorting means for distributing and sorting paper sheets to said plurality of bins; and a binding section comprising means for driving the binding section up and down along said plurality of bins, said binding section comprising a stapler for binding stacks of paper sheets distributed to said plurality of bins;

said binding section being removable from said sorting section;

wherein said binding section is constructed as a unit and is mountable and dismountable from said sorting section in a direction in which paper sheets are driven out into said sorting section.

2. The paper handling apparatus as claimed in claim 1, wherein said sorting section has a space for accommodating said binding section.

3. The paper handling apparatus as claimed in claim 1, wherein said sorting section and said binding section are provided with wheels to be freely movable.

4. A paper handling apparatus comprising:

a housing;

a plurality of bins arranged one above another;

paper moving means movable up and down along said plurality of bins for gripping an end portion of a stack of paper sheets received from an image forming apparatus, sorted and distributed to any one of said bins, pulling out said stack of paper sheets by a predetermined distance from said bin, and returning said stack of paper sheets into said bin;

stapling means for stapling an end portion of the stack of paper sheets having been pulled out by said paper moving means;

a stapler door provided on said housing at the front of a movable range of said stapling means; and another door provided on said housing;

said stapling means continuing, when said another door is opened when said stapling means is performing a stapling operation, said stapling operation until said stapling operation completes.

5. A paper handling apparatus comprising:

a plurality of bins arranged one above another;

stapling means movable up and down along said plurality of bins for stapling an end portion of a stack of paper sheets which have been received from an image forming apparatus in any one of said plurality of bins, said stack of paper sheets being received in a face down manner in any one of said plurality of bins such that said stapling means drives a staple into said stack of paper sheets from the underside of said stack; and moving means for moving said stapling means between a substantially horizontal stapling position for stapling the stack of paper sheets and a staple supply position for supplying staples to said stapling means.

6. An apparatus as claimed in claim 5, wherein said stapling means is rotatable about a single shaft between said stapling position and said staple supply position.

7. A paper handling apparatus as claimed in claim 6, in which said single shaft comprises a substantially horizontal shaft.

8. A paper handling apparatus as claimed in claim 7, further comprising a lever for controlling said movement of said stapling means between said stapling position and said staple supply position.

9. A paper handling apparatus as claimed in claim 5, in which said staple supply position comprises a substantially vertical position.

* * * * *